US005238450A

United States Patent [19]

Rotter

[11] Patent Number: 5,238,450

[45] Date of Patent: Aug. 24, 1993

[54] AIR-PERMEABLE BARRIER FOR SOFFIT VENT

[76] Inventor: Martin J. Rotter, 115 Lismore Ave., Glenside, Pa. 19038

[21] Appl. No.: 792,994

[22] Filed: Nov. 15, 1991

[51] Int. Cl.[5] ..... F24F 7/00

[52] U.S. Cl. ..... 454/260

[58] Field of Search ..... 454/260; 52/95, 101

[56] References Cited

U.S. PATENT DOCUMENTS

| | | | |
|---|---|---|---|
| 1,651,071 | 11/1927 | Scheppers | 454/260 X |
| 2,200,031 | 5/1940 | Lee | 454/260 X |
| 3,240,144 | 3/1966 | Lind | 454/260 |
| 3,972,164 | 8/1976 | Grange | 52/95 |
| 4,096,790 | 6/1978 | Curran | 454/260 |
| 4,102,092 | 7/1978 | Ward | 52/92 |
| 4,126,973 | 11/1978 | Luckey | 454/260 X |
| 4,189,878 | 2/1980 | Fitzgerald | 52/95 |
| 4,214,510 | 7/1980 | Ward | 454/260 |
| 4,222,315 | 9/1980 | Weirich | 454/260 |
| 4,611,443 | 9/1986 | Jorgensen et al. | 52/95 |
| 4,660,463 | 4/1987 | Bottomore et al. | 454/260 |
| 4,762,053 | 8/1988 | Wolfert | 454/260 |
| 4,776,262 | 10/1988 | Curran | 454/260 |
| 4,977,714 | 12/1990 | Gregory | 454/260 |

*Primary Examiner*—Harold Joyce

*Attorney, Agent, or Firm*—Seidel, Gonda, Lavorgna & Monaco

[57] ABSTRACT

An air-permeable barrier for soffit ventilation systems, and method for installing same to provide a barrier against insect ingress and flow blockage by internal insulation. The barrier comprises a flexible mat of randomly aligned fibers which is attached to the roof and sill plate between adjacent joists and rafters, and is flexed to extend into the eaves with the lateral edges of the barrier abutting the joists and rafters to create a barrier against the entry of insects into the attic. The mat further prevents insulation from blocking the soffit vents and provides an air channel to the attic along the roof sheathing. An alternative embodiment has a vapor barrier layer adhered to one face to channel air flow through the barrier in the longitudinal plane only to eliminate wind wash through the insulation. Such mat is installed by laying it between a joist and rafter with one end of the mat lying over the sill plate, then stapling the mat to the sill plate, bending the flexible mat such that it extends into the eaves and reflects back along the slope of the roof with the lateral edges abutting the rafters, and stapling the second end of the mat to the roof sheathing.

37 Claims, 1 Drawing Sheet

AIR-PERMEABLE BARRIER FOR SOFFIT VENT

TECHNICAL FIELD

This invention is related to the general field of roof and attic ventilation systems. It is particularly related to soffit ventilators.

BACKGROUND ART

It has been a long known practice to ventilate attics under gable roofs by the use of soffit ventilators.

Soffit ventilators are perforated or louvered vent openings in the underside (soffit) of the eaves of an overhanging roof. The vents allow fresh ambient air to flow into the attic to equalize interior temperature and pressure with the outside. This equalization inhibits moisture from condensing on insulation and wood roofing materials, prevents build-up of ice dams which could buckle shingles and gutters, and reduces air-conditioning costs when hot attic air is replaced by cooler ambient air.

A soffit ventilator system may work in conjunction with a passive roof vent or with a forced-air fan to provide positive ventilation. As hot stale air is withdrawn through the roof vent by convection, wind suction, and/or forced flow, it is replaced by fresh ambient air through the soffit vents.

Attic floors (ceilings of the space below) in such buildings are generally heavily insulated between the joists, either by strips of fiberglass batt set between the floor joists or by loose fiber or particulate insulation blown into the attic to fill between and cover the joists to depths of six inches or more. To be fully effective, the insulation should cover the entire attic floor, extending out to the sill plate of the exterior side walls. However, it is difficult blow fiber or particulate insulation right up to the sill plate without causing a significant quantity to fall across the plate into the eaves and settle on the soffit. If this material covers the screens or blocks the louvers of the soffit vents, the ventilating airflow may become inadequate.

Batt fiberglass is more easily to control than blown insulation, since it is cut to length from a roll and placed between the joists. However, if the batt height is such that the upper edge extends above the joists and presses against the roof sheathing, the ventilating air from the soffit vents may be blocked from flowing freely along the roof and replacing the attic air. In this situation, more conditioned air from the spaces below the insulated ceiling will be exfiltrated to the attic through holes along plumbing stacks and electrical feed wire to replace the attic air withdrawn through the roof vent. This results in a loss of thermal energy, and can cause deleterious moisture accumulation on attic structures as moisture from the warmer conditioned air condenses on the colder structures.

Further, any outside air flow which passes through the insulation layer enroute to the attic space reduces the insulation effectiveness by a phenomena known in the trade as "wind wash", or the passage of outdoor air through insulation. Fiber and particle insulation depend upon entrapping air within the insulating layer; consequently, when outside air is allowed to flow through the layer, it draws with it thermal energy from the conditioned spaces. Studies in cold climates have shown that wind wash occurs when the soffit air flow is allowed to pass through the insulation at the edges where the exterior side walls meet an insulated ceiling, and is responsible for significant heat loss. Ventilating air flow passing through the insulation layer may also release hazardous dust in the attic space.

Consequently, numerous types of baffles have been proposed to prevent insulation from being blown into the eaves, to provide an open flow channel below the roof sheathing, or to stop wind wash through the insulation. The following U.S. patents are illustrative of the wide variety of such baffles:

| | |
|---|---|
| U.S. Pat. No. 3,240,144 | Lind |
| U.S. Pat. No. 3,972,164 | Grange |
| U.S. Pat. No. 4,096,790 | Curran |
| U.S. Pat. No. 4,102,092 | Ward |
| U.S. Pat. No. 4,189,878 | Fitzgerald |
| U.S. Pat. No. 4,222,315 | Weirich |
| U.S. Pat. No. 4,214,510 | Ward |
| U.S. Pat. No. 4,611,443 | Jorgensen et al. |
| U.S. Pat. No. 4,660,463 | Bottomore et al. |
| U.S. Pat. No. 4,977,714 | Gregory |

Such prior art baffles attempt to solve the above problems by providing, in some manner, an unobstructed flow channel from the eaves into the attic space. However, soffit ventilation creates an additional problem in providing an entry point to the attic space by insects, particularly those which seek such spaces for nesting colonies, such as bees and wasps. The mesh of the soffit screens or size of the louvers must be large enough to prevent blockage by accumulated debris, yet openings of this size frequently allow easy ingress to insects. To combat this problem, U.S. Pat. No. 4,762,053 proposes a soffit vent with a replaceable small-mesh filter held in a filter frame over the inner side of the vent. Another approach is suggested in U.S. Pat. No. 4,222,315, wherein helical-rolled paper air conduits are press-fit into a fascia board with screened openings.

An object of this invention is to provide a soffit ventilation system with an air-permeable barrier against insect ingress and against flow blockage by internal insulation.

A further object is to provide an alternative embodiment of the invention which prevents wind wash through the insulation.

A further object is to provide such barrier by structure and material which is easily installed in a building, which is flame resistant, which does not wick, absorb or retain moisture, which does not react to cause decay or damage to the surrounding roofing materials, and which is sufficiently durable in normal environmental conditions that it should not need replacement during the lifetime of the roof.

A further object is to provide such barrier by structure which is easily installed, and which is configured for immediate installation in buildings having attic floor joists which are spaced at either the sixteen or twenty-four inch standard spacing.

SUMMARY DISCLOSURE OF THE INVENTION

An air-permeable barrier for soffit ventilation systems provides a barrier against insect ingress to the attic space and against ventilating flow blockage caused by internal insulation. The barrier comprises a flexible mat of randomly aligned fibers which is attached to the roof interior and to the vertical wall sill plate, and is flexed to extend into the eaves between adjacent joists and rafters, with the lateral edges of the barrier abutting the joists and rafters. The mat creates a barrier against the entry of insects into the attic, prevents insulation from blocking the soffit vents, and provides an air channel to the attic along the roof.

The mat is preferably constructed of randomly aligned synthetic fibers joined by phenolic or latex binding agents and heat cured. Such mat is flame resistant, does not wick, absorb or retain moisture, or react with wood or surrounding materials, and is sufficiently durable in normal environmental conditions that it should not need replacement during the lifetime of the roof.

The mat is preferably provided as a rectangular sheet of approximately 14½ inch width, 22½ inch length, and approximately ½ inch thickness. Such mat is configured for immediate installation in buildings having attic floor joists on either sixteen or twenty-four inch standard-spaced centers, and is easily installed by laying it between a joist and rafter such that the mat's lateral edges abut against the joist or rafter, with one end of the mat lying over the sill plate, then stapling the mat to the sill plate, bending the flexible mat such that it extends into the eaves and reflects back along the slope of the roof with the lateral edges abutting the rafters, and stapling the second end of the mat to the roof sheathing by a row of staples along the rafter on each side. The seam between the lateral edges of the mat and the joists or rafters may be sealed with caulk.

An alternative embodiment provides the same mat with a vapor barrier layer covering one flat side, and is installed in the above manner with the layer facing the installer. This embodiment is intended for colder climate structures with thick insulation layers, and channels the air flow longitudinally through the mat to eliminate wind wash or the release of hazardous dust from air flowing through insulation.

BRIEF DESCRIPTION OF THE DRAWINGS

For the purpose of illustrating the invention, the drawings show a form which is presently preferred. It should be understood, however, that this invention is not limited to the precise arrangements and instrumentalities shown.

BEST MODE FOR CARRYING OUT THE INVENTION

Figure 1:
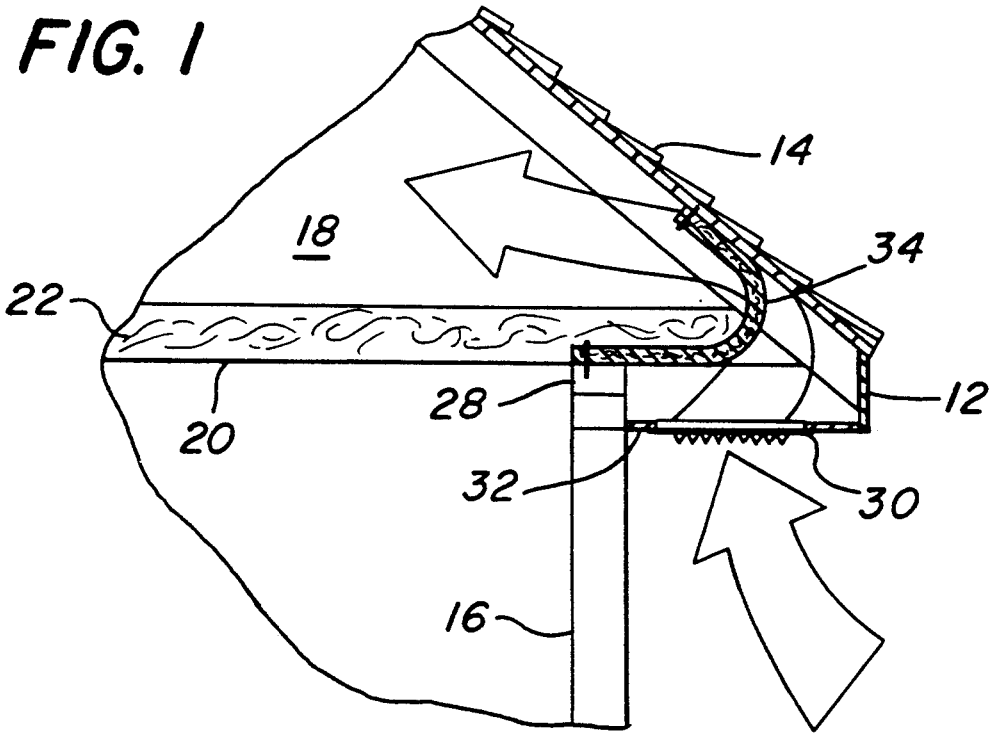
FIG. 1 is a vertical section of a portion of a house showing the relationship of an air-permeable barrier according to the present invention to a soffit ventilation system.
Figure 2:
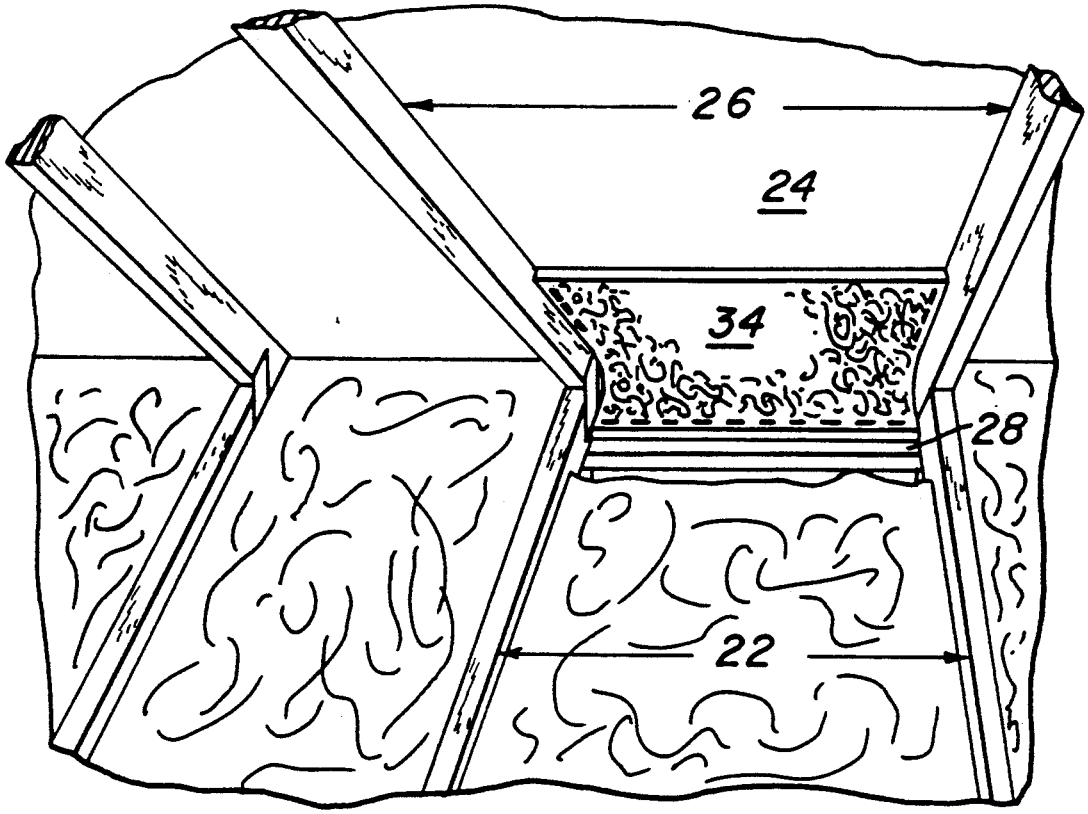
FIG. 2 is plan view of the interior of an attic space with an air-permeable barrier according to the present invention.

Referring now to FIG. 1, there is shown a ventilated building (10) of the type including eaves (12) formed by a sloping roof (14) which extends beyond one or more vertical side walls (16). An attic space (18) is enclosed between the roof and an internal ceiling (20). The ceiling forms the floor of the attic, and as shown in FIG. 2, is constructed on a plurality of parallel joists (22). Similarly, the roof is constructed of plywood sheathing (24) on a plurality of parallel rafters (26). The joists and rafters are supported by a sill plate (28) capping the vertical side wall.

Vents (30) in the eaves soffit (32) allow external ambient air to flow into the attic space, as shown by the arrows in FIG. 1. The vents may be screen mesh over orifices in the soffit, or louvers as depicted in FIG. 1. Those familiar with the art will recognize the foregoing as representative of a typical soffit ventilation system.

An air-permeable barrier (34) according to the invention is disposed between the roof and wall plate and between adjacent joists and adjacent rafters. The barrier extends into the eaves such that lateral edges the mat abut against its adjacent joist or rafter, as shown in FIGS. 1 and 2.

As best seen in FIG. 2, the barrier (34) is preferably constructed of rectangular mats. Although for purpose of illustration and contrast only one mat is depicted in FIG. 2, it will be understood that a mat will normally be attached between each joist/rafter pair to close the entire attic against insect ingress. Maintaining ventilating airflow only requires placing the barrier between joist/rafter pairs which are over a soffit vent, but unless communication between the eaves and attic is blocked by some other structure, it will be normal convention to attach the barrier mats along the entire eaves area.

The mat itself is preferably constructed of randomly aligned synthetic fibers joined by phenolic or latex binding agents and heat cured. Such material is flame resistant, does not wick, absorb or retain moisture, or react with wood or ordinary roofing materials, and is sufficiently durable to normal environmental conditions that it should not need replacement during the lifetime of the roof. Additional detail about such material may be obtained from my co-pending application No. 07/745,573, entitled "ROOF VENT OF SYNTHETIC FIBER MATTING", and incorporated herein by reference, although it should be noted that the dimensions and structural properties such as tear and tensile strength, resilience and compression resistance which were used in the roof vent matting are not required in the barrier mats described herein. A mat used as the barrier of this invention only requires sufficient thickness to create a convoluted air passage that excludes insects, and sufficient flexibility to allow it to be bent into and hold a contour which reflects back along the roof sheathing as shown in FIG. 2.

For ease of installation without cutting, the mat is preferably provided in rectangular sheets of approximately 14½ inch width and 22½ inch length. Since standard joist and rafter spacing is on either sixteen inch or twenty-four inch centers, the mat will fit either standard spacing. The mat may preferably have approximately ½ inch thickness. Lesser thickness may not provide a sufficiently convoluted air passage to exclude insects, and while greater thickness can be used, it is generally unnecessary and requires longer staples to secure it to the wood structure.

An alternative embodiment for colder climates where attic floors may have very thick insulation layers, of eight to fourteen inches or more, has the above described mat with the addition of a vapor barrier layer covering one flat face. Insulation of this thickness extends well above the floor joists and sill plate, and if not baffled in some manner will allow "wind wash", or the flow of cold outside air through the insulation at the wall edges. Consequently, the alternative embodiment mat is installed with the barrier layer on the inside, which prevents the ventilating air from flowing out the flat face into the insulation, and instead channels the air flow longitudinally through the mat to the attic space. Since the randomly aligned synthetic fiber with heat cured binder does not trap or significantly retard convective air flow, the barrier layer only eliminates wind wash and exfiltration, and prevents release of hazardous dust from air flowing through insulation.

The vapor barrier layer may be any suitable impermeable material in a thin sheet, and may preferably be attached by adhesive to the random fiber material before the material is cut into rectangular mats. An example of such material is an aluminized paper with vinyl coating, with the vinyl side adhered to the mat material.

This alternative embodiment will thus comply with emerging building and energy codes which address wind wash and exfiltration in cold climate regions, such as the 1991 amendments to the Minnesota Energy Code (Minnesota Rules: chapter 7670), which specifically requires a barrier against wind wash at the exterior edge of attic insulation in residential buildings. Other cold weather states such as Washington and Oregon have energy codes which state a general requirement for baffling to deflect ventilating air above the surface of blown or poured insulation.

Method of Installation

Each mat is easily installed by laying it between an adjacent joist and rafter pair such that the mat's two lateral edges each abut against a joist or rafter, with one end of the mat lying over the sill plate. The alternative embodiment with a vapor barrier is installed by laying it with the barrier layer up, or facing the installer. The mat is then stapled to the sill plate with a row of staples or other type of tacking across the plate. The installer then pushes the mid-section of the mat into the eaves area and bends it such that it extends into the eaves and reflects back along the slope of the roof with its lateral edges abutting the rafters. Care should be taken to not push the mat so far into the eaves that it creates a sharp corner conforming to the roof angle; instead, a rounded angle should be formed to allow air to rise behind the mat, as shown in FIG. 1. The free end of the mat is then stapled to the roof sheathing with a row of staples or other tacking along each side adjacent the rafter, as shown in FIG. 2. Staples normally should not be placed across the mat to secure the top end of the mat to the roof.

To make a tighter barrier and to hold the mat in position, the seam between the lateral edges of the mat and the joists or rafters may be sealed with a synthetic rubber or other suitable roofer's caulk or adhesive. A bead of such caulk may also be laid across the sill plate before stapling, and across the back surface of the mat under the roof staples. The synthetic fiber material joined by phenolic or latex binding agents adheres well to such caulk and is not damaged or deteriorated by it.

INDUSTRIAL APPLICABILITY

The present invention is likely to be used extensively by builders in new construction homes having soffit ventilation and insulated attic spaces. It has a marked advantage in ease of installation over other devices which are intended to keep insulation from blocking soffit vents, in that it requires no carpentry, and that it is installed after the roof sheathing so that it causes no delay in covering the roof. Its use further permits use of soffit vents with wider louvers, which increase air draft into the attic and are less susceptible to blockage by external debris. It is likely to be used extensively where insect infiltration and nesting are problems during the warmer seasons. The non-flammable properties of the mat material may also be required by some building codes for new construction ventilation systems.

The alternative embodiment is likely to be used extensively by builders in residential buildings in cold climates, particularly where building and energy codes require vent channels above the insulation or barriers against wind wash.

The present invention may be embodied in other specific forms without departing from the spirit or essential attributes thereof and, accordingly, reference should be made to the appended claims, rather than to the foregoing specification, as indicating the scope of the invention.

I claim:

1. In a ventilated building of the type including eaves formed by a sloping roof which extends beyond one or more vertical side walls, an attic space enclosed between the roof and an internal ceiling, said ceiling being constructed on a plurality of parallel joists and said roof being constructed on a plurality of parallel rafters, said joists and rafters supported by a sill plate capping said each vertical side wall, and having vents in the soffit of said eaves to allow external ambient air into the attic space, the improvement comprising:

an air-permeable barrier to prevent the entry of insects into the attic through the soffit vents and to prevent blockage of the soffit vents by fibrous or particulate insulation laid within the attic space, said barrier comprising an air-permeable flexible mat which is attached at one end thereof to the sill plate, and is flexed to extend into the eaves and reflect back along the interior slope of the roof, with the lateral edges thereof abutting the adjacent joists and rafters.

2. The barrier of claim 1, further comprising the mat being of randomly aligned synthetic fibers joined by phenolic or latex binding agents and heat cured.

3. The barrier of claim 1, further comprising the mat being flame resistant.

4. The barrier of claim 2, further comprising the mat being flame resistant.

5. The barrier of claim 1, further comprising the mat being a rectangular sheet of approximately 14 inch width and 22 inch length.

6. The barrier of claim 2, further comprising the mat being a rectangular sheet of approximately 14 inch width and 22 inch length.

7. The barrier of claim 3, further comprising the mat being a rectangular sheet of approximately 14 inch width and 22 inch length.

8. The barrier of claim 5, further comprising the mat being of approximately ½ inch thickness.

9. The barrier of claim 6, further comprising the mat being of approximately ½ inch thickness.

10. The barrier of claim 7, further comprising the mat being of approximately ½ inch thickness.

11. The barrier of claim 2, further comprising the lateral edges of the mat being sealed against the abutting joists and rafters by a caulking material.

12. The barrier of claim 7, further comprising the lateral edges of the mat being sealed against the abutting joists and rafters by a caulking material.

13. The barrier of claim 1, further comprising the mat being non air-permeable through its side thereof which faces the interior of the attic space.

14. The barrier of claim 13, wherein the mat includes a vapor barrier layer covering a flat side thereof, and is installed such that said flat side with vapor barrier faces the interior of the attic space.

15. The barrier of claim 2, further comprising the mat being non air-permeable through its side thereof which faces the interior of the attic space.

16. The barrier of claim 15, wherein the mat includes a vapor barrier layer covering a flat side thereof, and is installed such that said flat side with vapor barrier faces the interior of the attic space.

17. The barrier of claim 9, further comprising the mat being non air-permeable through its side thereof which faces the interior of the attic space.

18. The barrier of claim 17, wherein the mat includes a vapor barrier layer covering a flat side thereof, and is installed such that said flat side with vapor barrier faces the interior of the attic space.

19. For use in a ventilated building of the type including eaves formed by a sloping roof which extends beyond one or more vertical side walls, an attic space enclosed between the roof and an internal ceiling, said ceiling being constructed on a plurality of parallel joists and said roof being constructed on a plurality of parallel rafters, said joists and rafters supported by a sill plate capping said each vertical side wall, and having vents in the soffit of said eaves to allow external ambient air into the attic space:

a barrier means to prevent the entry of insects into the attic through the soffit vents and to prevent blockage of the soffit vents by fibrous or particulate insulation laid within the attic space;

said barrier means comprising a plurality of air-permeable flexible mats, each mat attached at one end thereof to the sill plate, and flexed to extend into the eaves and reflect back along the interior slope of the roof, with the lateral edges thereof abutting the adjacent joists and rafters.

20. The barrier means of claim 19, further comprising each mat being a flexible mat of randomly aligned fibers having a varying mesh sufficient to create a barrier against the entry of insects into the attic through the soffit vents.

21. The barrier means of claim 20, further comprising each mat being of randomly aligned synthetic fibers joined by phenolic or latex binding agents and heat cured.

22. The barrier means of claim 21, further comprising the lateral edges of each mat being sealed against the abutting joists and rafters by a caulking material.

23. The barrier means of claim 21, further comprising each mat being flame resistant.

24. The barrier means of claim 20, further comprising each mat being a rectangular sheet of approximately 14 inch width and 22 inch length.

25. The barrier means of claim 21, further comprising each mat being a rectangular sheet of approximately 14 inch width and 22 inch width.

26. The barrier means of claim 24, further comprising each mat being of approximately ½ inch thickness.

27. The barrier means of claim 25, further comprising each mat being of approximately ½ inch thickness.

28. The barrier means of claim 19, further comprising each mat being non air-permeable through its side thereof which faces the interior of the attic space, and each mat installed such that said flat side with vapor barrier faces the interior of the attic space.

29. The barrier means of claim 20, further comprising each mat being non air-permeable through its side thereof which faces the interior of the attic space, and each mat installed such that said flat side with vapor barrier faces the interior of the attic space.

30. The barrier means of claim 21, further comprising each mat being non air-permeable through its side thereof which faces the interior of the attic space, and each mat installed such that said flat side with vapor barrier faces the interior of the attic space.

31. The barrier means of claim 27, further comprising each mat being non air-permeable through its side thereof which faces the interior of the attic space, and each mat installed such that said flat side with vapor barrier faces the interior of the attic space.

32. A method of creating a barrier to prevent the entry of insects into an attic through soffit vents and to prevent blockage of the soffit vents by fibrous or particulate insulation, for use in a ventilated building of the type which has eaves formed by a sloping roof which extends beyond one or more vertical side walls, an attic space enclosed between the roof and an internal ceiling, said ceiling being constructed o a plurality of parallel joists and said roof being constructed on a plurality of parallel rafters, said joists and rafters supported by a sill plate a vertical side wall, and having vents in the soffit of said eaves to allow external ambient air into the attic space, said method comprising the steps of:

(a) laying an air permeable flexible mat between joists such that each lateral edge of the mat abuts against its adjacent joist, and one end potion of the mat lies over the sill plate, (b) attaching the mat to the sill plate, (c) bending the flexible mat such that it extends into the eaves between the joists and rafters and reflects back along the slope of the roof, with the lateral edges abutting the adjacent rafters, (d) attaching the second end portion of the mat to the roof.

33. The method of claim 32, wherein the steps of attaching the mat to the sill plate and attaching the second end portion of the mat to the roof include stapling the mat to the sill plate and roof.

34. The method of claim 33, further comprising the step of caulking the lateral edges of the mat which abut the rafters.

35. A method of creating a barrier to prevent the entry of insects into an attic through soffit vents, to prevent blockage of the soffit vents by fibrous or particulate insulation, and to eliminate wind wash through the insulation, for use in a ventilated building of the type which has eaves formed by a sloping roof which extends beyond one or more vertical side walls, an attic space enclosed between the roof and an internal ceiling, said ceiling being constructed on a plurality of parallel joists with fiber or particulate insulation between said joists, and said roof being constructed on a plurality of parallel rafters, said joists and rafters supported by a sill plate a vertical side wall, and having vents in the soffit of said eaves to allow external ambient air into the attic space, said method comprising the steps of:

(a) laying an air permeable flexible mat, which has a vapor barrier layer covering a flat side thereof, between joists such that each lateral edge of the mat abuts against its adjacent joist, with said vapor barrier layer facing the installer and one end portion of the mat lying over the sill plate, (b) attaching the mat to the sill plate, (c) bending the flexible mat such that it extends into the eaves between the joists and rafters and reflects back along the slope of the roof, with the lateral edges abutting the adjacent rafters, and the vapor barrier layer facing the interior attic space, (d) attaching the second end portion of the mat to the roof.

36. The method of claim 35, wherein the steps of attaching the mat to the sill plate and attaching the second end portion of the mat to the roof include stapling the mat to the sill plate and roof.

37. The method of claim 36, further comprising the step of caulking the lateral edges of the mat which abut the rafters.

* * * * *